United States Patent [19]

Kaanta et al.

[11] Patent Number: 5,036,630

[45] Date of Patent: Aug. 6, 1991

[54] RADIAL UNIFORMITY CONTROL OF SEMICONDUCTOR WAFER POLISHING

[75] Inventors: Carter W. Kaanta, Colchester; Howard S. Landis, Underhill, both of Vt.

[73] Assignee: International Business Machines Corporation, Armonk, N.Y.

[21] Appl. No.: 509,267

[22] Filed: Apr. 13, 1990

[51] Int. Cl.[5] ..... B24B 1/00; B24B 7/00

[52] U.S. Cl. ..... 51/283 R; 51/281 SF; 51/324; 51/322; 51/131.4

[58] Field of Search ..... 51/324, 235, 283 E, 51/281 SF, 237 R, 131.1-131.5, 322

[56] References Cited

U.S. PATENT DOCUMENTS

| | | | |
|---|---|---|---|
| 4,207,381 | 6/1980 | Aisaka et al. | 428/619 |
| 4,313,284 | 2/1982 | Walsh | 51/131.4 |
| 4,414,286 | 11/1983 | Ty | 428/616 |
| 4,450,652 | 5/1984 | Walsh | 51/131.4 |
| 4,517,041 | 5/1985 | Hennenfent et al. | 51/324 X |
| 4,637,962 | 1/1987 | Albrecht et al. | 428/616 |
| 4,728,232 | 3/1988 | Babel | 409/135 |

FOREIGN PATENT DOCUMENTS

| | | | |
|---|---|---|---|
| 187455 | 10/1984 | Japan | 51/131.4 |
| 109066 | 4/1989 | Japan | 51/131.4 |

*Primary Examiner*—D. S. Meislin

*Attorney, Agent, or Firm*—William D. Sabo

[57] ABSTRACT

Disclosed is an improved method of polishing a semiconductor wafer, which involves mounting the wafer to a wafer carrier comprising at least two materials having different coefficients of thermal expansion and regulating the temperature of the carrier, to thereby impart a convex (or concave) bias to the wafer. This provides an increased polishing action at the wafer center (or edges), so as to compensate for otherwise non-uniform radial polishing action across the wafer surface. Also disclosed, is an apparatus which incorporates the unique wafer carrier and temperature regulating means for achieving the desired degree of radial curvature of the wafer carrier.

13 Claims, 2 Drawing Sheets

RADIAL UNIFORMITY CONTROL OF SEMICONDUCTOR WAFER POLISHING

BACKGROUND OF THE INVENTION

1. Technical Field

This invention relates to a method and apparatus for polishing a semiconductor wafer, and, more particularly, to an improved method and apparatus so as to obtain a substantially uniform polishing action across the surface of the wafer.

2. Description of the Prior Art

Various methods and tools for polishing a semiconductor wafer are known in the art. In general, these tools include upper and lower plates, between which wafers are positioned for polishing. In operation, the two plates are moved relative to each other, and a slurry, consisting of an abrasive solution with or without an etching reagent, is fed between the plates to grind and flush away the material removed from the wafer.

During polishing, it has been found, however, that the load imposed on the wafer leads to a higher concentration of slurry contacting the wafer edges, than its center. As a result, there is a greater polishing action at the edges, thus causing center-to-edge non-uniformity in thickness and poor flatness of the wafer.

Efforts have been made in the art to obtain a more uniform polishing action across the wafer. For example, U.S. Pat. No. 4,313,284, issued to Walsh on Feb. 1982, discloses a method and apparatus for adjusting the surface shape of the upper plate or wafer carrier. In carrying out the method, a vacuum source is connected to the carrier, so as to apply a pressure difference which distorts the carrier into a concave shape. This shape is sought so that the carrier surface will conform to that of the lower plate or turntable (which mounts a polishing pad), which distorts from thermal and mechanical stress during polishing.

Another approach is disclosed in U.S. Pat. No. 4,450,652, issued to Walsh on May 29, 1984, where a constant temperature is maintained on the top and bottom surfaces of the turntable to maintain the wafer carrier and the turntable at the same thermal bow distortion. The temperature differential is maintained constant by sensing the temperature of the polishing pad, then regulating the pressure applied to the wafer.

In both references, the curvature of the wafer carrier surface is distorted so as to conform to the curvature of the turntable. Also, the distortion is obtained by changing the pressure applied to the wafer carrier. Neither reference seeks, however, to regulate the curvature of the wafer carrier surface, so that it is bowed with respect to the turntable, so as to produce a different degree of polishing action at different points across the wafer surface.

SUMMARY OF THE INVENTION

Now, in accordance with the invention, an improved method of polishing a surface on a workpiece has been discovered. Preferably, the process involves polishing a surface on a semiconductor wafer by mounting the wafer to a wafer carrier comprising at least two materials having different coefficients of thermal expansion. The temperature of the carrier is regulated to control the radial curvature, thus imparting a convex (or concave) bias to the wafer. As a result, a greater polishing action can be effected at the center (or the edges) of the wafer, if desired, to achieve a uniform thickness of the surface being polished across the wafer.

In accordance with another aspect of the invention, there is provided an improved apparatus for polishing a surface on a workpiece. In a preferred embodiment, the apparatus is used for polishing a surface on a semiconductor wafer, and it comprises a rotatable turntable assembly, a polishing pad supported on the assembly, a rotatable wafer carrier located above the assembly and adapted to hold a wafer during polishing, with the wafer positioned between the carrier and the polishing pad, and temperature regulating means, communicating with the carrier. It is a critical feature that the wafer carrier comprises at least two materials having different coefficients of thermal expansion. The temperature of the carrier is regulated via the temperature regulating means to control the radial curvature, to impart a concave or convex bias to a wafer mounted to the carrier during polishing.

The foregoing and other objects, features and advantages of the invention will be apparent from the following more particular description of the preferred embodiments of the invention.

Detailed Description

Figure 1:
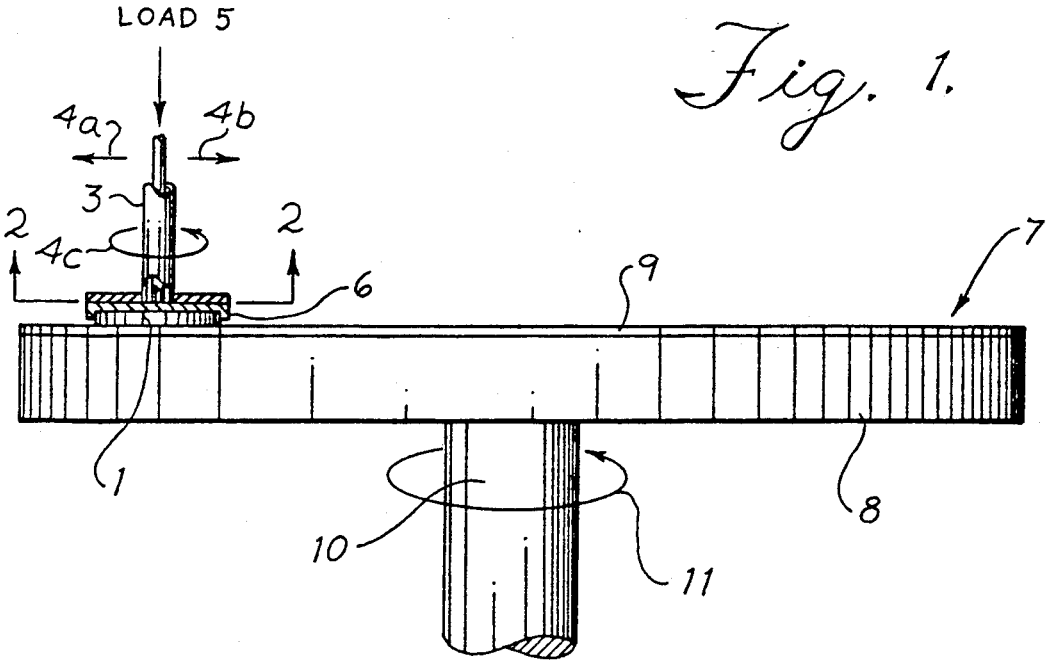
FIG. 1 is a schematic illustration , partially in cross-section, of an apparatus for polishing a semiconductor wafer, according to an embodiment of the invention.

Referring to the drawings, FIG. 1 shows an improved apparatus for polishing a semiconductor wafer 1. The apparatus includes a wafer carrier 2 which is coupled to a spindle 3, which in turn is coupled to any suitable motor or driving means (not shown) for moving the carrier 2 in the directions indicated by the arrows 4*a*, 4*b* and 4*c* (rotation). The spindle 3 supports a load 5, which is exerted against the carrier 2 and thus against the wafer 1 during polishing. The carrier 2 includes an edge portion 6, which prevents the wafer 1 from sliding out from under the carrier 2 as the carrier 2 moves.

The semiconductor wafer 1, which is to be polished in accordance with the method of the invention, is shown mounted to the carrier 2, positioned between the carrier and a rotatable turntable assembly, indicated generally by the numeral 7, located below the carrier 2. The turntable assembly 7 includes a polishing table 8, on which a polishing pad 9 is positioned, and the polishing table 8 is rotated around the shaft 10 in the direction indicated by the arrow 11 by any suitable motor or driving means (not shown).

Figure 3:
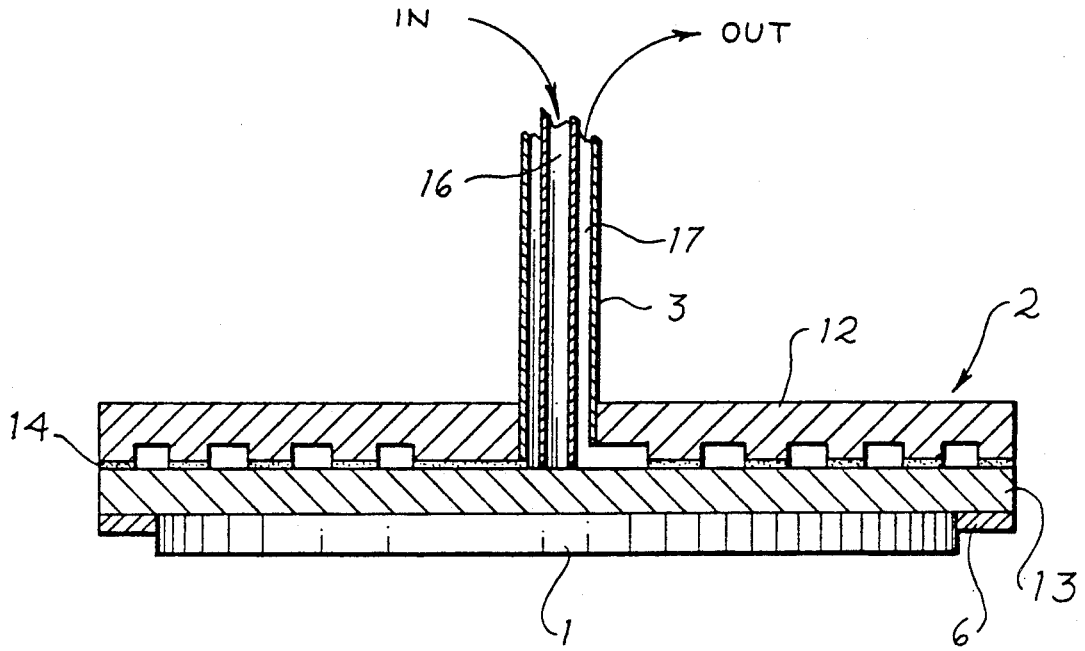
FIG. 3 is a view in cross-section, with parts cut-away, of the wafer carrier taken along the line 3—3 of FIG. 2.

During polishing, a slurry (not shown) is usually applied between the wafer carrier 2 and the polishing table 8. Due to the load 5 which is imposed on the wafer carrier 2, a higher concentration of slurry generally contacts the wafer edges, as previously noted, resulting in a greater polishing action at the edges. In order to overcome this problem, a unique wafer carrier structure is employed in accordance with the invention. Referring to FIG. 3, the wafer carrier 2 includes an upper portion 12 and a lower portion 13, the two portions 12 and 13 being made of materials having different coefficients of thermal expansion. In general, the two portions 12 and 13 are made of any suitable materials, preferably metal, and are joined via a suitable brazing material 14, e.g. silver solder, known to those skilled in the art.

Figure 2:
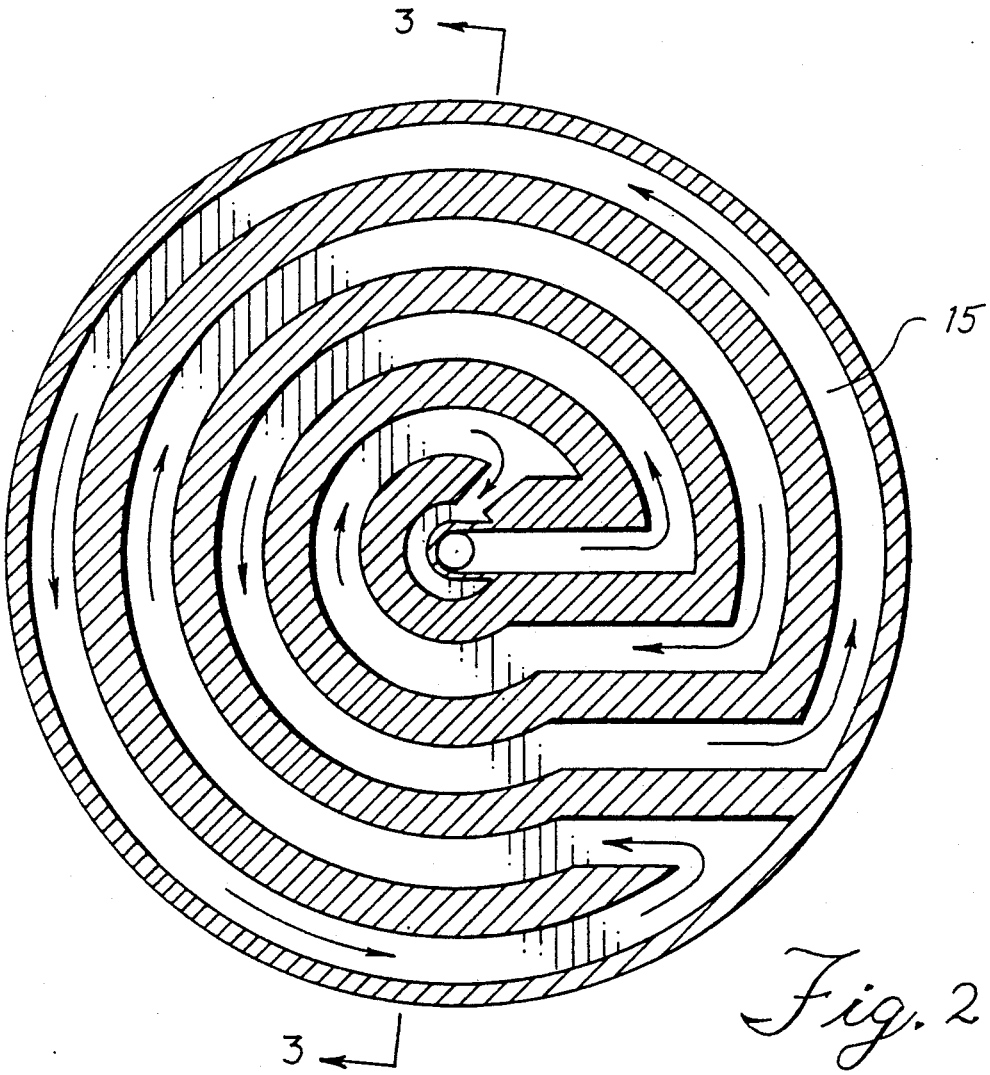
FIG. 2 is a view in cross-section, somewhat enlarged, of the wafer carrier taken along the line 2—2 of FIG. 1.

As described in more detail below, the temperature of the wafer carrier 2 is regulated, and because the upper and lower portions 12 and 13 are made of materials having different coefficients of thermal expansion, a change is accordingly effected in the radial curvature of the carrier 2. The temperature of the carrier 2 is satisfactorily regulated by circulating a suitable fluid, such as water, through the carrier. The upper portion 12 is provided with a fluid chamber 15, in the form of a serpentine channel, located at the surface of the brazing material 14. A serpentine configuration is advantageous for uniformly regulating the temperature of the carrier 2. The fluid for heating/cooling the carrier 2 is introduced to and withdrawn from the chamber 15 via fluid inlet 16 and fluid outlet 17, respectively, within the interior of the spindle 3. The fluid flow path through the serpentine channel is best seen in FIG. 2.

Figure 4:
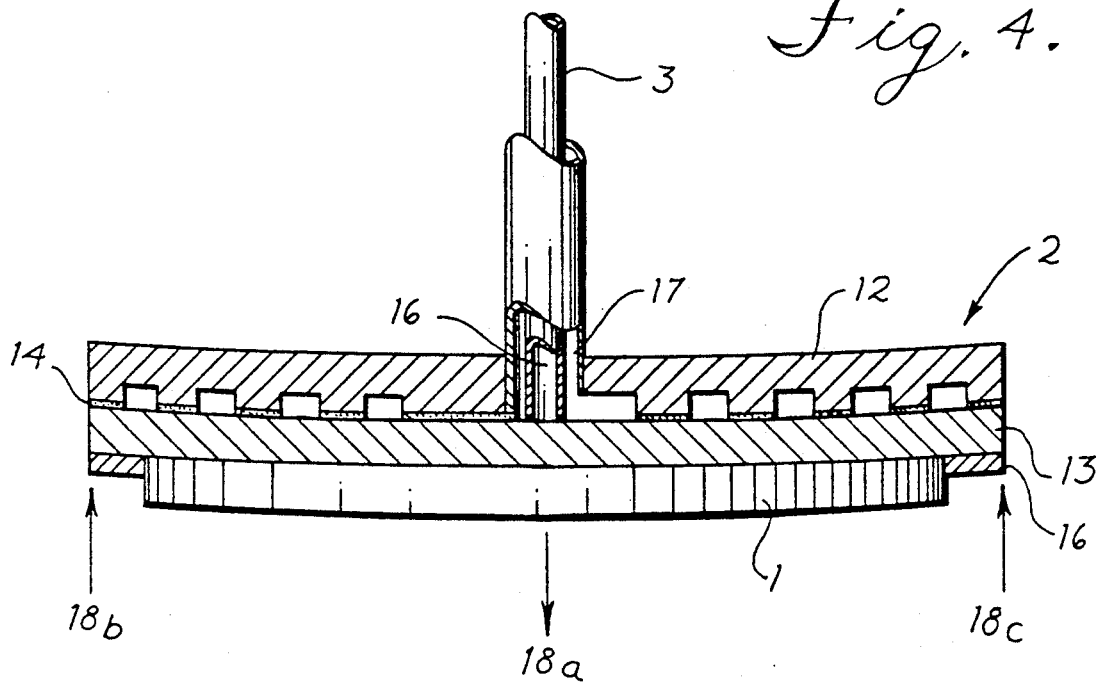
FIG. 4 is a view in cross-section, similar to FIG. 3, of the wafer carrier, imparting a convex bias to a wafer.

In practice, the wafer carrier 2 is constructed so that it has a relatively flat shape, as shown in FIG. 3, at reference temperature, which is generally room temperature. Generally, the lower portion 13 is made of the material with the higher coefficient of thermal expansion, although this is not necessary. Then, if it is desired to impart a convex bias to a wafer 1 mounted to the carrier 2, the temperature of the carrier is raised by increasing the temperature of the water flowing through the fluid chamber 15 above reference temperature, so as to cause the carrier to deflect upwardly at the outside edges, as depicted by the arrows 18*a*, 18*b* and 18*c* shown in FIG. 4. This results in an increase in polishing action at the center of the wafer, to compensate for the generally greater polishing action due to a higher slurry concentration at the wafer edges.

On the other hand, depending upon the particular apparatus being employed and the nature of the polishing action sought, the rate of polishing at the edges of the wafer 1 can be increased by cooling the carrier 2 below reference temperature. This will cause the carrier 2 to deflect downwardly at the outside edges to impart a concave bias to the wafer 2.

The upper and lower portions, 12 and 13, respectively, of the carrier can be made of any suitable materials, so long as they have sufficiently different coefficients of thermal expansion for the degree of carrier deflection sought. As should be apparent, the greater the difference in the relative coefficients of thermal expansion of the materials employed, the greater the degree of deflection for a given temperature change. Conversely, the more similar the coefficients are, the less the degree of deflection for a given temperature change, and this may be particularly advantageous when more precise control is desired; if the coefficients are quite similar, for example, the degree of deflection may be quite small for a given temperature change. Although a wide selection of materials can be chosen, generally speaking, metals are preferred, and in one particularly preferred embodiment, a stainless steel, such as 304 stainless steel, is employed as the lower portion 13, and a nickel-based alloy, such as "Hastelloy C" (available from Union Carbide Corp.), as the upper portion 12.

Various modifications can be made in the method and apparatus without departing from the spirit of the invention, as should be apparent to those skilled in the art. For example, the lower portion 13 can be made of the material with the lower coefficient of thermal expansion; this may be desirable, when it is desired to produce a concave deflection of the carrier 2 by effecting an increase in the carrier temperature. Under those circumstances, a decrease in carrier temperature, to below that of the reference temperature would, of course, produce, a convex deflection of the carrier 2.

Thus, the method and apparatus of the invention allow wide lattitude in practice, to achieve a uniform polishing action over the wafer surface. Also, if desired, a dynamic adjustment can be made to achieve uniform radial polishing, by modulating the temperature of the carrier 2. This may be desired, for example, as a polish pad 9 becomes worn during use.

In addition, the method and apparatus of the invention can be employed in polishing a wide variety of surface materials on the wafer, such as silicon, e.g. monocrystalline silicon or polysilicon, common insulator materials, e.g. silicon dioxide, or other inorganic or organic insulator materials, e.g. polyimide, common conductor materials, e.g. metals, and so forth. Further, a surface which follows a varying topography can be polished, so that a uniform removal of material is achieved.

As also should be apparent, a wide range of materials L or workpieces, e.g. glass, can be polished. Moreover, it may be desired under some circumstances to form, instead of a uniformly flat surface, a surface having a degree of curvature, as desired. Other modifications should be apparent to those skilled in the art.

What is claimed is:

1. A method of polishing a surface on a workpiece, employing a polishing apparatus wherein said workpiece is mounted to a carrier and rotatably contacted with a polishing pad to effect a polishing action across said workpiece, which method comprises mounting said workpiece to a carrier comprising at least two materials having different coefficients of thermal expansion, that are sufficiently different so that the carrier deflects to a desired curvature in response to a given temperature, and regulating the temperature of said carrier to control the radial curvature of said carrier, to impart a concave or convex bias to said workpiece during polishing.

2. A an apparatus for polishing a surface on a workpiece, employing a polishing apparatus wherein said workpiece is mounted to a carrier and rotatable contacted with a polishing pad to effect a polishing action across said workpiece, which method comprises mounting said workpiece to a carrier comprising at least two materials having different coefficients of thermal expansion, and regulating the temperature of said carrier to control the radial curvature of said carrier, to impart a concave or convex bias to said workpiece during polishing, and wherein said carrier comprises a lower metal portion which mounts said workpiece and an upper metal portion, said lower metal portion comprising said material having the higher coefficient of thermal expansion.

3. The method of claim 2, wherein said lower metal portion comprises a stainless steel and said upper metal portion comprises a nickel-based alloy.

4. The method of claim 2, wherein the temperature of said carrier is regulated so as to impart a convex bias to said workpiece to increase the polishing action near the center of said workpiece during polishing.

5. A method of polishing a surface on a semiconductor wafer, employing a polishing apparatus wherein said wafer is mounted to a wafer carrier and rotatably contacted with a polishing pad to effect a polishing action across said wafer, which method comprises mounting said wafer to a wafer carrier comprising at least two materials having different coefficients of thermal expansion, that are sufficiently different so that the carrier deflects to a desired curvature in response to a given temperature, and regulating the temperature of said carrier to control the radial curvature of said carrier, to impart a concave or convex bias to said wafer during polishing.

6. A method of polishing a surface on a semiconductor wafer, employing a polishing apparatus wherein said wafer is mounted to a wafer carrier and rotatably contacted with a polishing pad to effect a polishing action across said wafer, which method comprises mounting said wafer to a wafer carrier comprising at least two materials having different coefficients of thermal expansion, and regulating the temperature of said carrier to control the radial curvature of said carrier, to impart a concave or convex bias to said wafer during polishing; wherein said carrier comprises a lower metal portion which contacts said wafer and an upper metal portion, said lower metal portion comprising said material having the higher coefficient of thermal expansion; and wherein the temperature of said carrier is regulated to as to impart a convex bias to said wafer to increase the polishing action near the center of said wafer during polishing.

7. An apparatus for polishing a surface on a workpiece, comprising: a rotatable turntable assembly; a polishing pad supported on said assembly; a rotatable carrier, located above said assembly and adapted to hold a workpiece during polishing, with said workpiece positioned between said carrier and said polishing pad, said carrier comprising at least two materials having different coefficients of thermal expansion, that are sufficiently different so that the carrier deflects to a desired curvature in response to a given temperature; and temperature regulating means communicating with said carrier for regulating the temperature of said carrier to control the radial curvature of said carrier, to impart a concave or convex bias to a workpiece mounted to said carrier during polishing.

8. The apparatus of claim 7, wherein said temperature regulating means comprises a fluid chamber within said carrier, and means for introducing and withdrawing fluid to and from said fluid chamber.

9. The apparatus of claim 8, wherein said fluid chamber is a serpentine channel.

10. An apparatus for polishing a surface on a workpiece, comprising: a rotatable turntable assembly; a polishing pad supported on said assembly; a rotatable carrier, located above said assembly and adapted to hold a workpiece during polishing, with said workpiece positioned between said carrier and said polishing pad, said carrier comprising at least two materials having different coefficients of thermal expansion; and temperature regulating means communicating with said carrier for regulating the temperature of said carrier to control the radial curvature of said carrier, to impart a concave or convex bias to a workpiece mounted to said carrier during polishing; and wherein said carrier comprises a lower metal portion which is adapted to mount a workpiece being polished and an upper metal portion, said lower portion comprising said material having the higher coefficient of thermal expansion.

11. The apparatus of claim 10, wherein said lower metal portion comprises a stainless steel and said upper metal portion comprises a nickel-based alloy.

12. A an apparatus for polishing a surface on a semiconductor wafer, comprising: a rotatable turntable assembly; a polishing pad supported on said assembly; a rotatable wafer carrier, located above said assembly and adapted t hold a wafer during polishing, with said wafer positioned between said carrier and said polishing pad, said wafer carrier comprising at least two materials having different coefficients of thermal expansion, that are sufficiently different so that the carrier deflects to a desired curvature in response to a given temperature; and temperature regulating means communicating with said carrier for regulating the temperature of said carrier to control the radial curvature of said carrier, to impart a concave or convex bias to a wafer mounted to said carrier during polishing.

13. A an apparatus for polishing a surface on a semiconductor wafer, comprising: a rotatable turntable assembly; a polishing pad supported on said assembly; a rotatable wafer carrier, located above said assembly and adapted to hold a wafer during polishing, with said wafer positioned between said carrier and said polishing pad, said wafer carrier comprising at least two materials having different coefficients of thermal expansion; and temperature regulating means communicating with said carrier for regulating the temperature of said carrier to control the radial curvature of said carrier, to impart a concave or convex bias to a wafer mounted to said carrier during polishing; and wherein said temperature regulating means comprises a fluid chamber which is a serpentine channel within said carrier, and means for introducing and withdrawing fluid to and from said fluid chamber; and wherein said carrier comprises a lower metal portion which is adapted to contact a wafer being polished and an upper metal portion, said lower portion comprising said material having the higher coefficient of thermal expansion.

* * * * *